US005546123A

United States Patent [19]

Ikeda et al.

[11] Patent Number: 5,546,123

[45] Date of Patent: Aug. 13, 1996

[54] AUTOMATIC STEERING DEVICE FOR ASPHALT FINISHER

[75] Inventors: Hachiro Ikeda; Noriaki Miyamoto, both of Tagajo; Ryoei Umeda, Tokyo; Hidenori Yasu, Kadoma; Mitsuo Fukukawa; Yukiei Masuyama, both of Tokyo; Shoji Kinoshita, Kounosu; Yukio Takagi, Tokyo; Tomohiro Gocho, Omiya; Fumio Goto, Gunma; Akio Ishii, Gunma-gun; Tetsuo Ogawa, Gunma-gun; Yoshun Hasegawa, Yokohama; Keitaro Hironaka, Yokohama; Yasuhiro Ogoshi, Yokohama, all of Japan

[73] Assignee: Niigata Engineering Co. Ltd., Tokyo, Japan

[21] Appl. No.: 223,746

[22] Filed: Apr. 6, 1994

[30] Foreign Application Priority Data

Apr. 9, 1993 [JP] Japan ..... 5-018062 U

[51] Int. Cl.[6] ..... H04N 7/18

[52] U.S. Cl. ..... 348/119; 404/84.2; 404/84.5

[58] Field of Search ..... 348/113, 118, 348/119, 125, 128, 129, 131, 135; 356/400; 404/84.1, 84.8, 90, 118, 84.2, 84.5; H04N 7/18

[56] References Cited

U.S. PATENT DOCUMENTS

| | | | |
|---|---|---|---|
| 3,298,352 | 1/1967 | Vrablik . | |
| 3,972,623 | 8/1976 | Funayama | 356/400 |
| 4,345,852 | 8/1982 | Goto et al. | 404/118 |
| 4,543,578 | 9/1985 | Tomoyori et al. | 348/118 |
| 4,682,909 | 7/1987 | Mihara | 404/90 |
| 4,854,769 | 8/1989 | Fukakawa et al. | 404/84.1 |
| 4,861,189 | 8/1989 | Fukukawa et al. | 404/84.1 |
| 5,245,422 | 9/1993 | Borcherts et al. | 348/119 |
| 5,393,167 | 2/1995 | Fujita et al. | 404/118 |

FOREIGN PATENT DOCUMENTS

| | | |
|---|---|---|
| 2270380 | 5/1975 | France . |
| 2609068 | 7/1988 | France . |
| 1459720 | 12/1968 | Germany . |
| 32883 | 5/1986 | Japan . |
| 34781 | 11/1992 | Japan . |

OTHER PUBLICATIONS

European Search Report No. 94105518 PCT Application No. PCT/AU83/00175 (Jun. 7, 1984).

*Primary Examiner*—Tommy P. Chin
*Assistant Examiner*—Richard Lee
*Attorney, Agent, or Firm*—Kane, Dalsimer, Sullivan, Kurucz, Levy Eisele & Richard, LLP

[57] ABSTRACT

An automatic steering device is presented for controlling the direction of travel of an asphalt finisher during a paving operation. The device is provided with a laser generator (18) which projects a laser beam of a slit shape on a series of objects along the roadside which is selected to served as a reference line (A). An image recording device (17), a CCD camera, is disposed on the vehicle member (2), which records the projected laser light illuminating the objects and outputs a generated image (Ba) to a master controller (22). The master controller (22) determines the current deviation of the vehicle member (2) from the reference line (A) by the changes in the position of the generated image (Ba), and operates the automatic control device so as to steer the vehicle member (2) in the correct direction to permit the asphalt finisher to follow the reference line (A).

9 Claims, 4 Drawing Sheets

AUTOMATIC STEERING DEVICE FOR ASPHALT FINISHER

BACKGROUND OF THE INVENTION

1. Field of the Invention

The present invention relates in general to a paving apparatus, and relates in particular to an automatic steering control device for an asphalt finisher.

2. Technical Background

Efficient operation of an asphalt finisher is a key to high quality and cost effective construction of the roadway. The asphalt finisher (referred to as finisher hereinbelow) must be operated such that the asphalt is levelled quickly and accurately in accordance with the required design of the roadway. Proper steering of the finisher is a critical factor in achieving the efficient paving operation.

An automatic steering device known in the field, (for example in a Japanese Patent Application, Second Publication, H4-32883) comprises three photodetectors arranged on a side of the finisher to detect a reference line along the roadside, and the data are outputted to a controller. The controller monitors the current positions of the finisher with respect to the reference line periodically, and stores the respective current position data obtained at certain time intervals. The controller compares the current positional data with the previous positional data, and the steering direction is determined on the basis of the comparison data and the running period of the interval timer.

The above known arrangement presented a problem that there are only three detector devices provided for determining the travel direction of the finisher, it was not possible to display the details of the control process to monitor the progress of the actual paving operation. The accuracy of control was also not adequate.

SUMMARY OF THE INVENTION

The objective of the present invention is to present an automatic steering device for an asphalt finisher which provides accurate control over the steering task, and enables to monitor the details of the actual control details on a display screen. The above objective is achieved in a device comprising: steering wheels for governing the direction of travel of the asphalt finisher; an actuator for changing the direction of travel of the steering wheels; an image recording and outputting device for recording and outputting an image of a reference line formed in relation to a roadside line; a master controller for controlling the operation of the actuator in accordance with the output data from the image recording and outputting device.

Another feature of the above device is that it is provided with a light generator which projects a slit shaped beam, whose beam width extends in the direction of the width of the reference line, on the reference line at an angle to the vertical direction; and the image recording and outputting device records an image generated by the light projected on the reference line.

According to the arrangement of the automatic steering device of the present invention, the current direction of travel of the asphalt finisher is determined in relation to a reference line which is related to objects along the roadside. The amount and direction of the deviation of travel of the asphalt finisher is determined on the basis of the amount and direction of the deviation of the current position of the vehicle member with respect to the reference line displayed on a display device, therefore, an operator of the asphalt finisher is able to monitor the operation of the master controller to judge the current position easily and accurately. The automatic control device can also be provided with an alarm facility to alert the operator. The overall result of the automatic steering device for the asphalt finisher is that the paving operation can now be performed cost effectively.

PREFERRED EMBODIMENT OF THE INVENTION

Figure 1:
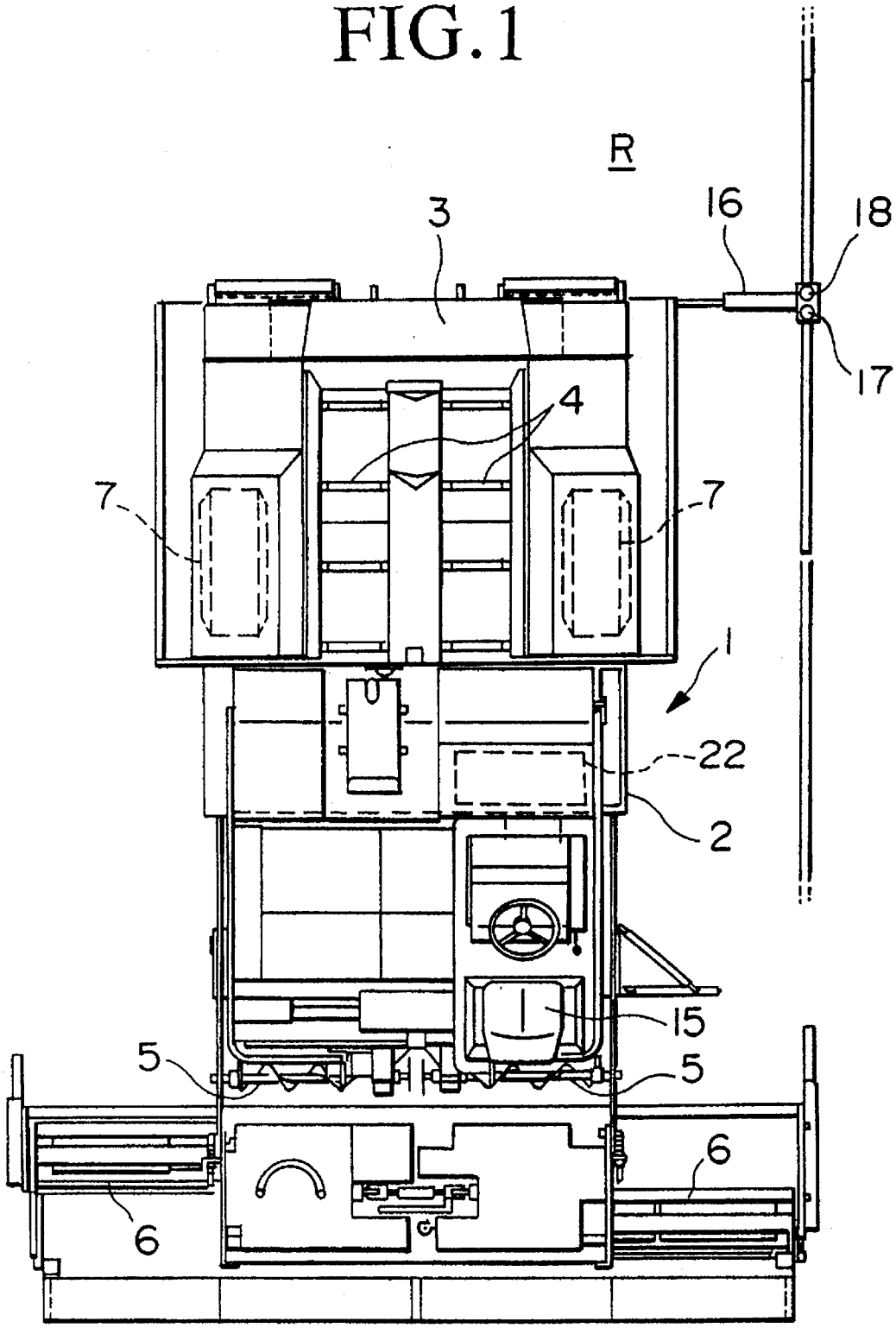
FIG. 1 is a schematic plan view showing the key members of the asphalt finisher equipped with an embodiment of the automatic steering control device of the present invention.
Figure 2:
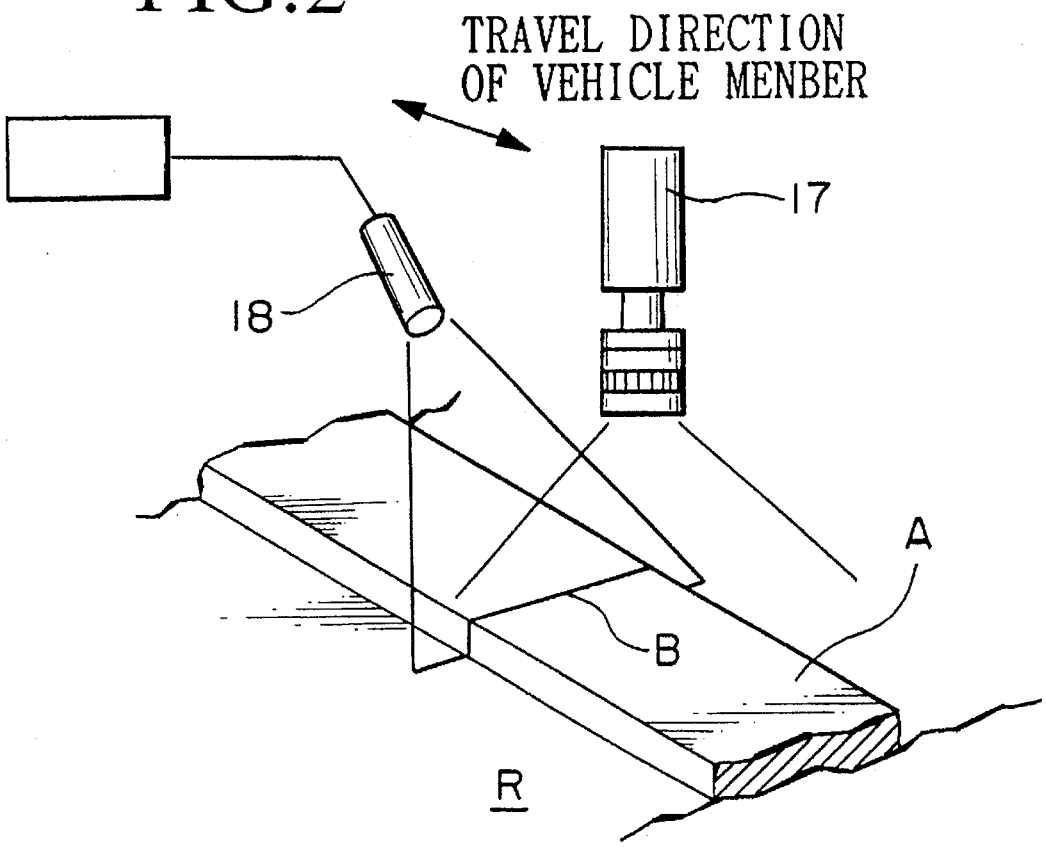
FIG. 2 is an example of the arrangement of the automatic control device of the present invention.

A preferred embodiment of the automatic steering control device of the present invention for use with an asphalt finisher will be explained with reference to FIGS. 1 to 5.

The asphalt finisher 1 is provided with a vehicle member 2 which has a hopper 3 at its front section, and a screw member 5 at its rear section, which serves to spread the asphalt mixture, forwarded from the hopper 3 by a back-feeder 4, to the left and right directions of the finisher 1. The finisher 1 is also provided with a left-right pair of screeds 6 for levelling the asphalt mixture spread by the screw member 5. The pair of screeds 6 is disposed so that one screed is slightly ahead of the other screed, and the screed are separately movable to the left or right of the finisher 1 by means of hydraulic cylinders, thereby changing the pavement width.

The vehicle member 2 is provided with the steering wheels (front wheels) 7, driving wheels (rear wheels, not shown) and a speed detector 8 (refer to FIG. 5) comprising such devices as rotary encorders. The steering wheels 7 are rotated to left or right by means of a steering rod 12 operated by the fluid-operated actuators 11 controlled by an electromagnetic (EM) switching valve 9 (refer to FIG. 4). The vehicle member 2 is moved by rotating the driving wheels with a hydraulic motor 14 controlled by a servo valve 13 (refer to FIG. 5). An operator sits in a seat 15. This basic configuration of the asphalt finisher 1 is known.

A support arm 16 is attached to the front end of the vehicle member 2, and a CCD (charge couple device) camera 17 and a semiconductor laser generator 18 are disposed on the end of the support arm 16. The laser generator 18 irradiates, at an angle to the vertical direction, a series of objects along the roadside, such as edging stones, with a laser beam of a slit shape (having its width extending in the direction of the width of the reference line A). An illuminated line B formed by the laser beam irradiating the objects along the roadside is recorded by the CCD camera 17 from the vertical direction as a generated image Ba. The support arm 16 can be moved in the horizontal direction so as to permit positional adjustments to be made to the camera 17 and the laser generator 18.

Figure 3:
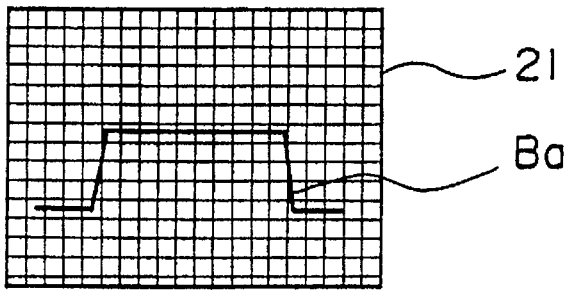
FIG. 3 is an example of the display of the image generated.
Figure 4:
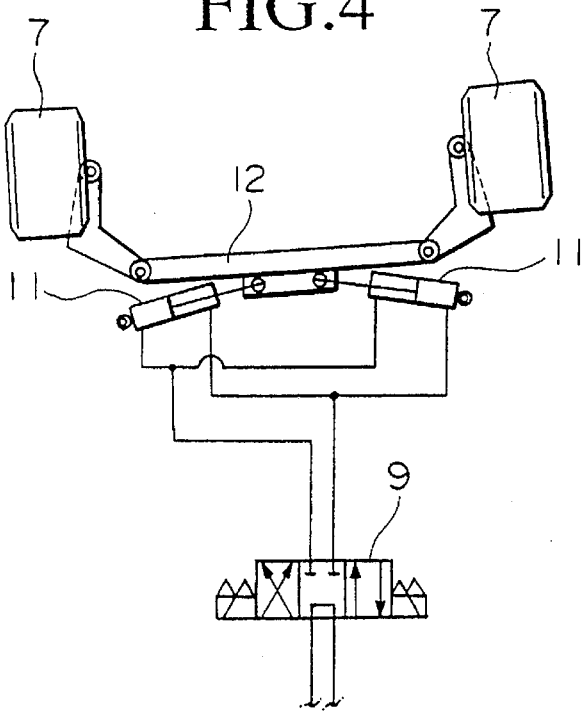
FIG. 4 is a plan view showing the relationship between the steering wheels and the actuators.
Figure 5:
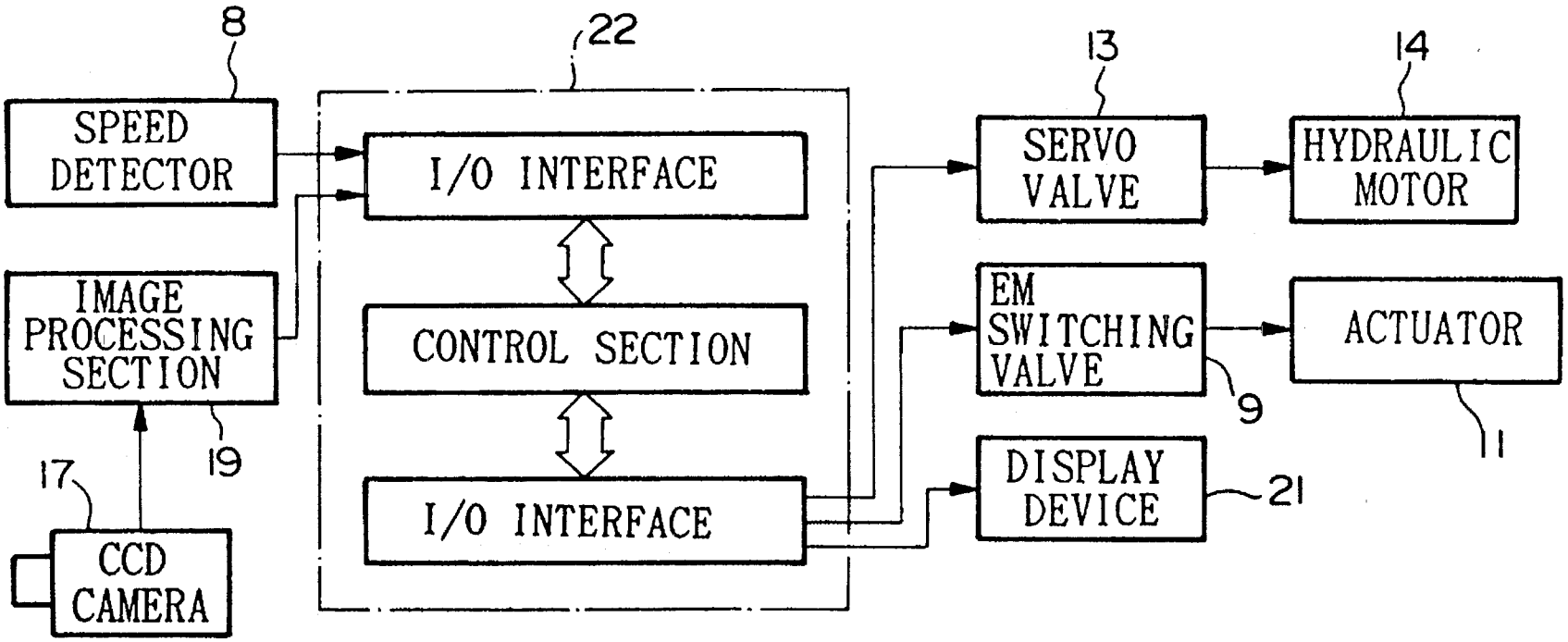
FIG. 5 a block diagram showing the interrelationship of the main control components of the embodiment.

The camera 17 is electrically connected to an image processing section 19 (refer to FIG. 5). The image processing section 19, the speed detector 8, the EM-switching valves 9, the servo valves 13, and the display device 21 are all connected electrically to the master controller 22. The display device 21 displays the image of the reference line A recorded by the CCD camera 17, or more accurately, the generated image Ba of the irradiated line B, as shown in FIG. 3. The display device 21 is disposed in an appropriate location in relation to the seat 15.

The master controller 22 comprises microcomputers which provide feedback directional control of the vehicle member 2. The master controller 22 determines the current position and the direction of travel of the vehicle member 2 on the basis of the output information generated by processing the signals from the camera 17 through the image processing section 19, and if it determines that the vehicle member 2 is too far to the right of the reference line A, then commands the steering wheels 7 to be turned to the left by switching the EM switching valve 9 to change the direction of travel of the vehicle member 2. If the current change in the direction of travel of the vehicle member 2 cannot keep pace with the curving of the road, the master controller 22 commands the servo valve 13 to decrease the vehicle speed, and if the lowering in the vehicle speed is incapable of compensating for the curving of the road R, then the master controller 22 commands the vehicle member 2 to stop temporarily.

Next, the operation of the embodiment of the automatic steering device of the present invention will be explained.

The paving operation is commenced by first disposing the camera 17 and the laser generator 18 directly above the reference line A, and then the laser light from the laser generator 18 is directed to the reference line A so that the vehicle member 2 can move forward. As the direction of the road R changes, the previously aligned relationship of the camera 17 and the laser generator 18 with respect to the reference line A becomes destroyed, and the current position of the generated image Ba recorded by the camera 17 changes.

The master controller 22 computes the amount and direction of the deviation of the vehicle member 2 on the basis of the amount and direction of the changes between the previous generated image Ba and the current generated image Ba, and commands the EM valve 9 to be switched so as to turn the steering wheels 7 to make the vehicle member 2 to correctly follow the reference line A. If the current change in the direction of travel of the vehicle member 2 cannot keep pace with the curving of the road R, the master controller 22 commands the servo valve 13 to decrease the vehicle speed, and if the lowering in the vehicle speed is still incapable of compensating for the curving of the road R, then the master controller commands the vehicle member 2 to stop temporarily.

The display device 21 displays the generated image Ba on the screen. Therefore, by looking at the screen, the operator is able to determine whether the current control operation by the master controller 22 is being carried out correctly.

Figure 6:
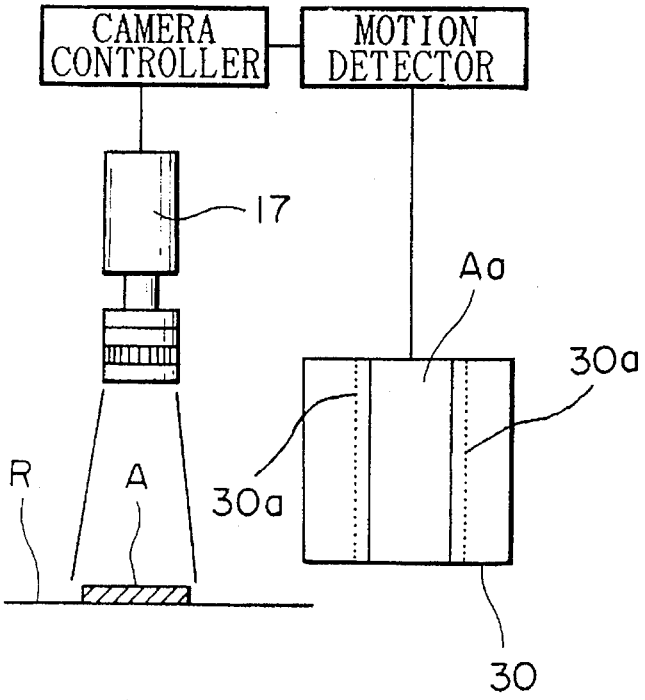
FIG. 6 is a schematic drawing showing the arrangement for another detection device.

FIG. 6 shows another embodiment of the automatic control device of the present invention. In this system, there is provided a series of latent check points 30*a* on the screen of the display device 30. The positions of the check points 30*a* can be specified freely anywhere on the screen. The system is designed to alert the operator by generating a signal when the reference line A coincides with one of the check points 30*a*. After selecting the position for a check point or checking points 30*a* on the screen, there is no need to keep displaying the point(s) on the screen, therefore, there is no disturbance to the viewing of the usual display image. To operate this system, the reference line A is recorded by the CCD camera 30, and the image Aa of the reference line A is displayed on the screen of the display device 30. The master controller 22 examines whether the reference line A is in the correct position with respect to the specified check point 30*a*, and if it is in the correct position, the controller 23 allows the processing to be carried out. Other configurations of the embodiment are the same as the first embodiment.

The reference objects other than edging stones, which can be used to define the reference line A are: edges of ditches, forming frames, previously paved road as well as colored lines drawn on the road. Those objects, such as white lines, which do not posses a height, it would be possible to use simple black and white displays to provide binary information displays to check the accuracy of alignment of the finisher with respect to the white reference line A.

What is claimed is:

1. A device for automatically controlling steering operation of an asphalt finisher (1) comprising:

(a) steering wheels for governing a direction of travel of said asphalt finisher (1);

(b) an actuator (11) for changing the direction of travel of said steering wheels;

(c) an image recording and outputting device (17) for recording and outputting an image of a reference line (A) formed in relation to a roadside line;

(d) a master controller (22) for controlling operation of said actuator (11) in accordance with output data from said image recording and outputting device (17);

wherein said image recording and outputting device (17) is provided with a light generator (18) which projects a slit shaped beam whose beam width extends in a direction of width of said reference line (A) on said reference line (A) at an angle to vertical direction; said image recording and outputting device (17) records an image (Ba) generated by said beam projected on the reference line (A).

2. A device as claimed in claim 1, wherein said image recording and outputting device (17) is a charge coupled device in the form of a CCD camera.

3. A device as claimed in claim 1, wherein said device is provided with a support arm (16) which supports said image recording and outputting device (17) so as to be freely movable in a direction approximately at right angles to a direction of travel of said asphalt finisher (1).

4. A device as claimed in claim 1, wherein said master controller (22) controls speed of travel of said asphalt finisher (1).

5. A device as claimed in claim 1, wherein said image recording and outputting device (17) is provided with a master display device (21, 30) which displays said image (Ba) generated by said image recording and outputting device (17).

6. A device as claimed in claim 5, wherein said master display device (21, 30) is provided with a plurality of latent check points which can be disposed within a screen of said display device (21, 30), and an alarm is sounded when said reference line (A) is superimposed on at least one of said plurality of latent check points.

7. A device as claimed in claim 1, wherein said light generator generates a laser beam.

8. A device as claimed in claim 7, wherein said device is provided with a support arm (16) which supports said image recording and outputting device (17) so as to be freely movable in a direction approximately at right angles to a direction of travel of said asphalt finisher (1).

9. A device as claimed in claim 7, wherein said master controller (22) controls speed of travel of said asphalt finisher (1).

* * * * *